US005135450A

United States Patent [19]

Smith, IV

[11] Patent Number: 5,135,450

[45] Date of Patent: Aug. 4, 1992

[54] EXERCISE SHOE WITH LIMITED RANGE OF ROCKING MOTION

[75] Inventor: Christopher J. B. Smith, IV, Oceanport, N.J.

[73] Assignee: Prostretch, Inc., Little Silver, N.J.

[21] Appl. No.: 728,987

[22] Filed: Jul. 12, 1991

[51] Int. Cl.[5] ..... A63B 23/04

[52] U.S. Cl. ..... 482/80; 36/7.5; 36/110; 128/25 B; 602/10

[58] Field of Search ..... 482/51, 75, 79, 80, 482/77, 146, 34, 71; 36/110, 7.5; 128/25 B, 80 R, 80 D; 602/10

[56] References Cited

U.S. PATENT DOCUMENTS

| | | | |
|---|---|---|---|
| 2,390,416 | 12/1945 | Bettmann | 128/80 D |
| 2,392,735 | 1/1946 | Hahn | 602/10 |
| 3,421,760 | 1/1969 | Freeman, Jr. | 482/80 |
| 3,613,674 | 10/1971 | Volz | 602/10 |
| 3,680,550 | 8/1972 | Tunstall | 602/10 |
| 4,206,558 | 6/1980 | Bivona | 36/7.5 |
| 4,446,856 | 5/1984 | Jordan | 128/80 R |
| 4,821,432 | 4/1989 | Reiber | 36/110 |
| 4,951,938 | 8/1990 | Smith, IV | 482/80 |

FOREIGN PATENT DOCUMENTS

| | | | |
|---|---|---|---|
| 1533522 | 7/1968 | France | 36/10 |

*Primary Examiner*—Robert Bahr
*Attorney, Agent, or Firm*—R. Gale Rhodes, Jr.

[57] ABSTRACT

An improved exercise shoe including a generally semi-circular base for engaging a support surface on which the exercise shoe rocks with a range of rocking motion, the improvement providing the exercise shoe with a more limited range, particularly a variable more limited range of rocking motion. The more limited range of rocking motion includes a more limited range of forward rocking motion and a more limited range of rearward rocking motion, and particularly a variable more limited rearward range of rocking motion.

12 Claims, 5 Drawing Sheets

EXERCISE SHOE WITH LIMITED RANGE OF ROCKING MOTION

BACKGROUND OF THE INVENTION

This invention relates to an improvement in the exercise shoe disclosed in U.S. Pat. No. 4,951,938 entitled EXERCISE SHOE, patented Aug. 28, 1990, Christopher J. B. Smith IV inventor and assigned to the same assignee as the present invention, and an improvement in the exercise shoe disclosed in design patent application Ser. No. 07/476,672, filed Feb. 8, 1990, entitled STRETCHING DEVICE FOR ROCKING THE FOOT TO STRETCH THE LOWER LEG, Christopher J. B. Smith IV inventor and assigned to the same assignee as the present invention. More particularly, this invention relates to an improved exercise shoe of the type disclosed in the aforementioned patent and patent application and wherein the range of rocking motion of such exercise shoe may be limited to one or more limited ranges of rocking motion, and still more particularly wherein such exercise shoe may be limited to one or more limited ranges of rearward rocking motion.

The exercise shoe disclosed in the above-identified patent and patent application, particularly patent application, is illustrated in FIG. 1 and identified by general numerical designation 10. The exercise shoe 10 includes a generally semi-circular base 12 for engaging a support surface 14, e.g. a floor, on which the exercise shoe 10 rocks. The exercise shoe 10 further includes a support member 16 extending generally upwardly from the base 12 and heel and ball support platforms 18 and 20 for respectively receiving the heel and ball of the foot of a person, and as may be noted from FIG. 1, the heel and ball support platforms are disposed at an acute included angle $\beta$ with respect to each other.

The exercise shoe 10 has a range of rocking motion, i.e. inherent range of rocking motion, $\Theta 1$ determined primarily by the arcuate or semi-circular length of the semi-circular base 12. Exercise shoe 10 has proven to be quite successful in stretching and strengthening various muscles and tendons in the lower leg and foot of a person. The person places a foot on the exercise shoe 10 with the heel of the person's foot residing on the heel platform 18 and with the ball of the person's foot residing on the ball platform 20; the person then rocks the exercise shoe alternately in the forward direction in the direction of the ball platform 10, and in the rearward direction in the, direction of the heel platform 18. Upon the exercise shoe 10 being rocked in the forward direction, plantarflexion occurs stretching and strengthening the anterior flexors, i.e. the anterior tibialis and extensor digitorum longus and to some extent the plantar fascia, and upon the exercise shoe 10 being rocked in the rearward direction, dorsiflexion occurs stretching and strengthening the plantar flexors, i.e. the gastrocnemius and soleus calf muscles, achilles tendon and plantar fascia.

In addition to being generally useful in stretching and strengthening the above-noted muscles and tendons, the exercise shoe 10 has been found to be particularly useful in post-operative rehabilitation of persons having experienced various surgical procedures on various of the above-noted muscles and tendons. In such post-operative rehabilitation, it has been found to be desirable to initially limit the person's foot to a limited range of rocking motion and to gradually increase the range of rocking motion to thereby gradually increasingly stretch and thereby gradually increasingly strengthen the operated muscles and tendons.

Accordingly, there exists a need in the exercise shoe art for a new and improved exercise shoe which may be provided with one or more limited ranges of rocking motion or, viewed alternately, which may be provided with a variable range of limited rocking motion, particularly a variable range of rocking motion.

SUMMARY OF THE INVENTION

An improved exercise shoe including a generally semi-circular base for engaging a support surface on which the exercise shoe rocks with a range of rocking motion, the improvement providing the exercise shoe with a more limited range, particularly a variable more limited range of rocking motion. The more limited range of rocking motion includes a more limited range of forward rocking motion and a more limited range of rearward rocking motion, and particularly a variable more limited rearward range of rocking motion.

DESCRIPTION OF THE PREFERRED EMBODIMENTS

Figure 1:
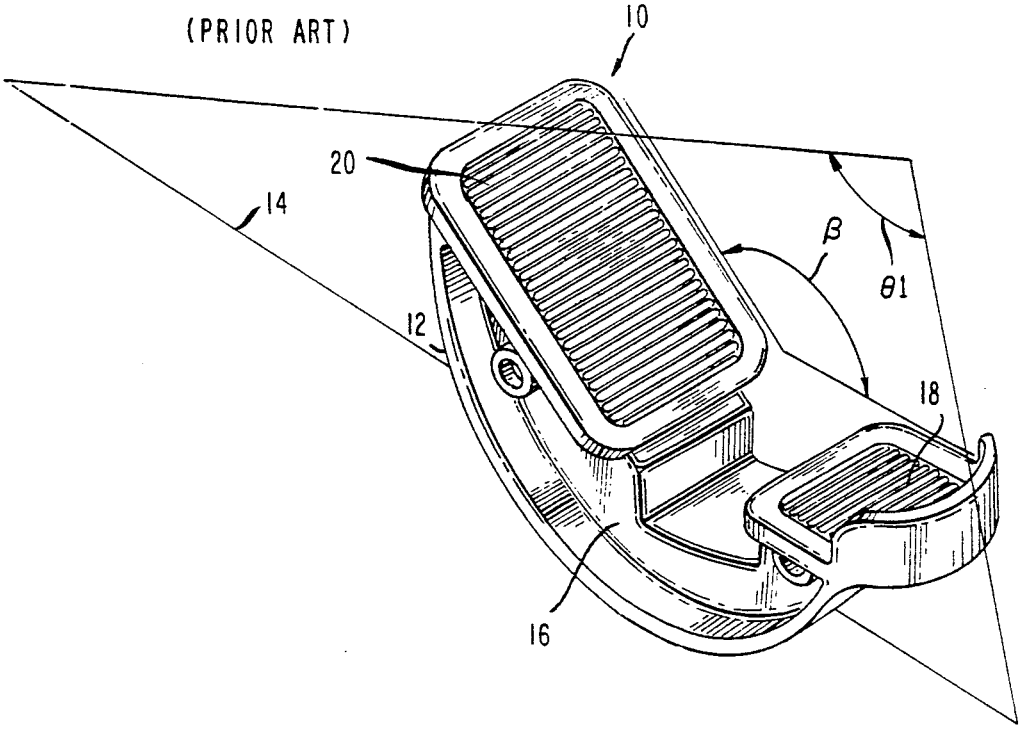
FIG. 1 (PRIOR ART)
FIG. 1 is a perspective view of a prior art exercise shoe.

A first embodiment of an improved exercise shoe 10A embodying the present invention is illustrated in FIG. 1 and a second or alternative embodiment of an improved exercise shoe 10B embodying the present invention is illustrated in FIGS. 3–9. For convenience of understanding, structural elements of the prior art exercise shoe illustrated in FIG. 1 present in the alternate embodiments 10A and 10B of the improved exercise shoe of the present invention are given the same numerical designations.

Figure 2:
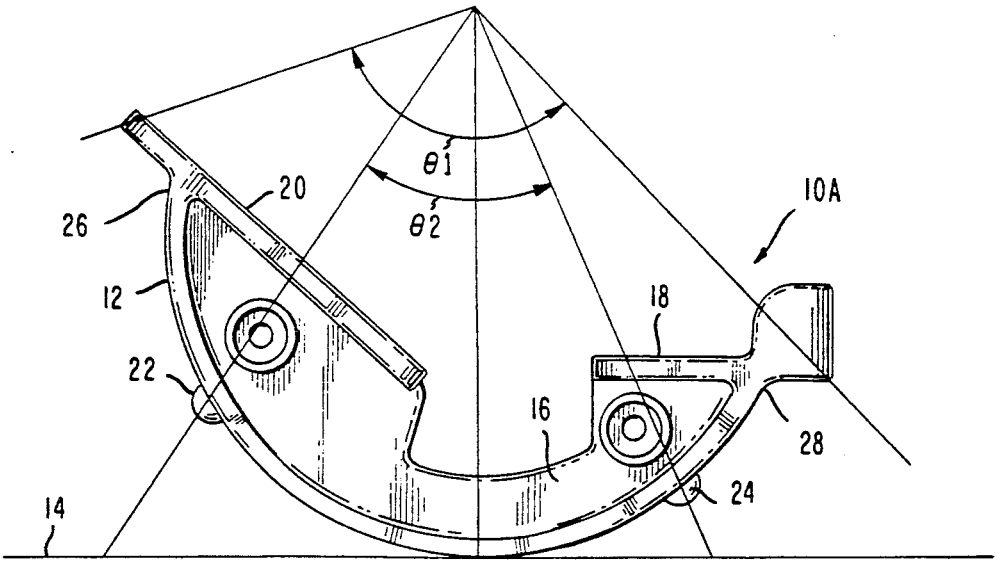
FIG. 2 is a side view of one embodiment of the exercise shoe of the present invention.

Referring to FIG. 2, the improved exercise shoe embodying the present invention illustrated in this figure is identified by general numerical designation 10A and includes a pair of members 22 and 24 extending outwardly from the generally semi-circular base 12 and inwardly of the opposed ends 26 and 28 of the base 12. It will be understood that the outwardly extending members 22 and 24 are spaced arcuately from each other, as shown in FIG. 2, and that the members are for alternately engaging the support surface 14 upon the exercise shoe 10A being rocked on the support surface to provide the exercise shoe 10A with a more limited range of rocking motion Θ2 which range Θ2, it will be noted from FIG. 2, is more limited than the range Θ1 of the prior art exercise shoe 10 of FIG. 1.

Figure 3:
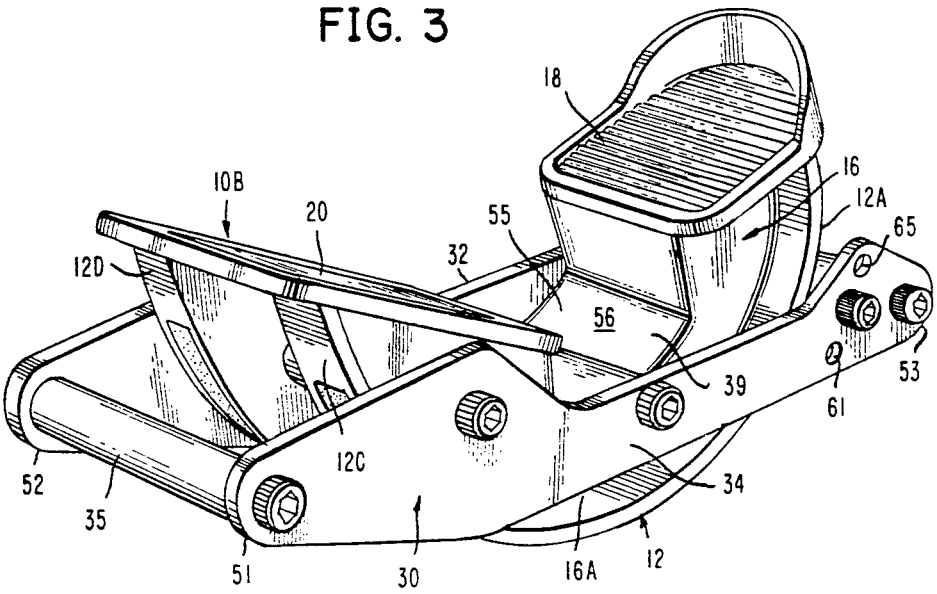
FIG. 3 is a perspective view of an alternate embodiment of the exercise shoe of the present invention.

Referring now to the second or alternate embodiment illustrated in FIGS. 3-9, and in particular to FIG. 3, it will be understood that the improved exercise shoe 10B of this embodiment includes a range of rocking motion limiting frame indicated by general numerical designation 30. Generally, and referring to FIG. 6 where the exercise shoe 10 and frame 30 are shown in the neutral position, it will be understood that the shoe 10, as above, has a range of rocking motion (i.e. inherent range of rocking motion) of Θ1 and that the frame 30 limits the exercise shoe 10 to a more limited range of rocking motion Θ3; further it will be understood that the range of rocking motion Θ3 includes a forward range of rocking motion Θ4 and a rearward range of rocking motion Θ5.

Figure 4:
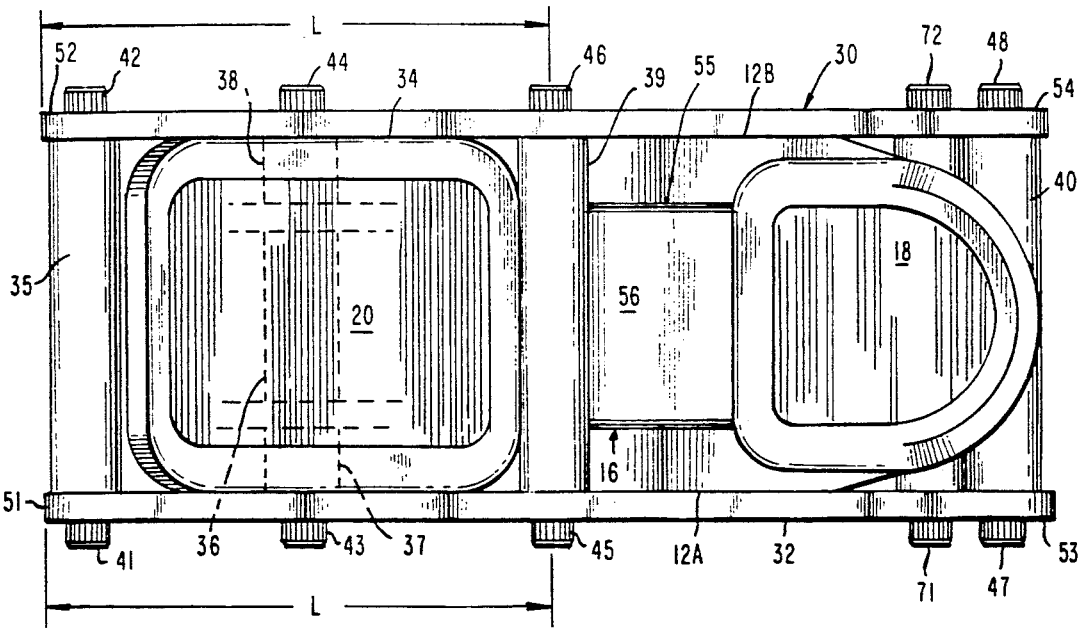
FIG. 4 is a top view of the exercise shoe shown in FIG. 3.
Figure 5:
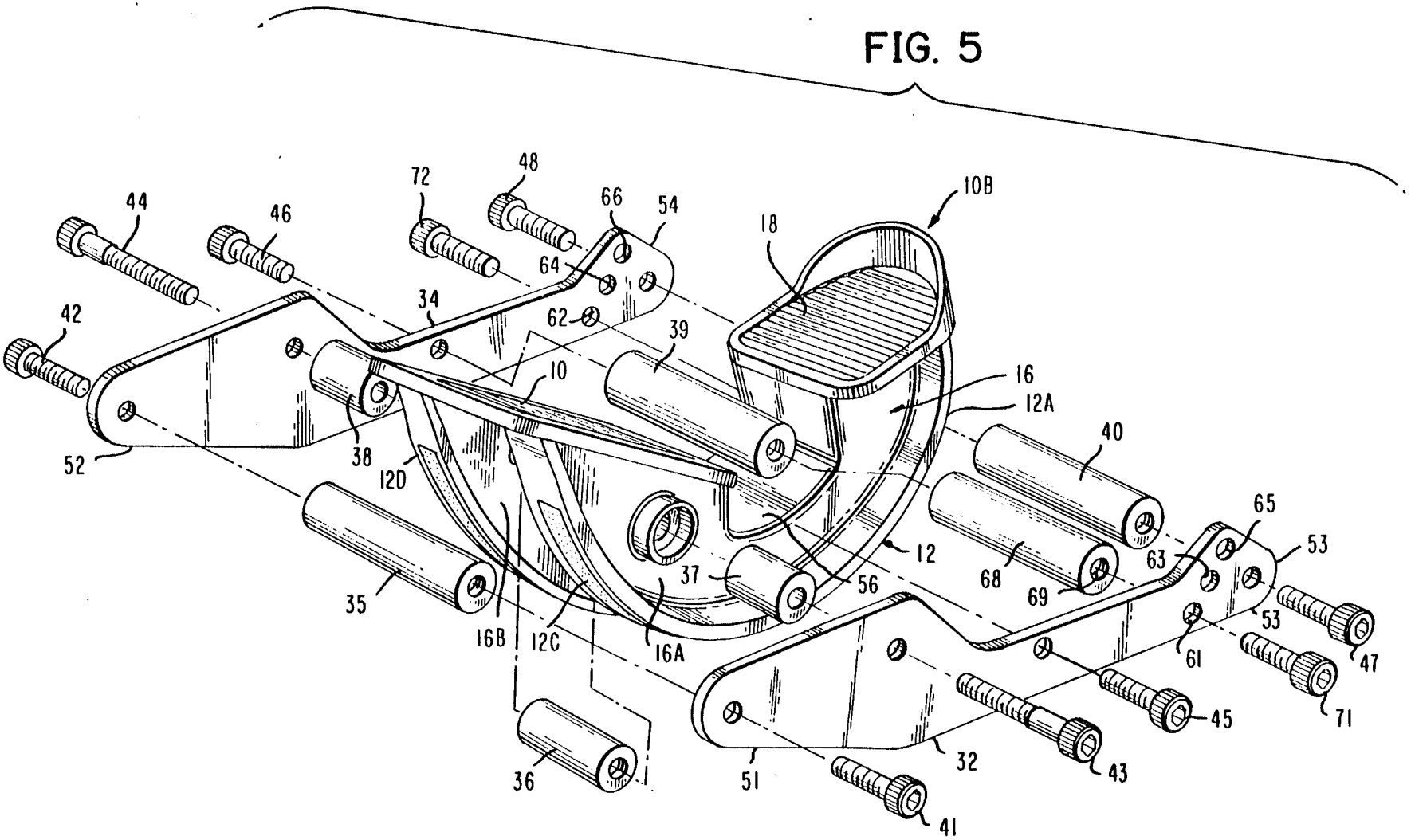
FIG. 5 is an exploded assembly view of the exercise shoe shown in FIGS. 3 and 4.

The structure of the frame 30 will be better understood by referring to FIGS. 4 and 5 where it will be noted that the frame 30 includes a pair of rails or side frame members 32 and 34 and a plurality of cylindrical connecting bars 35-40 and a plurality of threaded bolts 41-48 which function in opposed pairs as illustrated in FIG. 5, the opposed pairs of threaded bolts being associated with the connecting bars as shown in FIG. 5. It will be understood that the cylindrical connecting bars 35-40 are provided with threaded cylindrical bores extending therethrough the end portions of which are for being threadedly engaged by the associated opposed pairs of threaded bolts as indicated by the interrupted assembly lines shown in FIG. 5. Upon the cylindrical connecting bores 35-40 and associated opposed pairs of threaded bolts being aligned as indicated by the interrupted assembly lines in FIG. 5, and upon the associated threaded bolts being threaded into at least the opposed outer end portions of the threaded bores formed in the cylindrical connecting bars 35-40, the rocking motion limiting frame 30 is mounted or secured to the exercise shoe 10B with the rails or side frame members 32 and 34 placed in forced engagement with the opposed sides or side portions 12A and 12B, particularly FIG. 4, of the semi-circular base indicated by general numerical designation 12 and the rails or side frame members 32 and 34 are thereby mounted or secured to the opposed side or side portions 12A and 12B of the base 12. The side frame members or rails 32 and 34, FIGS. 3-5, include a pair of opposed forward end portions 51 and 52 and a pair of opposed rearward end portions 53 and 54. The support member indicated by general numerical designation 16 extending upwardly from the base 12 includes a middle portion 55 extending inwardly thereof to form a cavity 56 substantially centrally thereof. Connecting bar 39 is a central connecting bar residing generally in the cavity 56 and extending transverse to and mounted to the side frame members or rails 32 and 34 generally centrally thereof as may be best seen in FIG. 4. The side frame members or rails 32 and 34 have a forward length L, FIG. 4, measured forwardly from said central connecting bar 39 to the ends of the opposed pair of forward end portions 51 and 52 of the rails. In this embodiment, the base 12 includes a pair of spaced apart, parallel semi-circular members 12C and 12D best seen in FIGS. 3 and 5, and the support member 16 includes a pair of spaced apart, parallel upwardly extending members 16A and 16B extending upwardly from the semi-circular members 12C and 12D also best seen in FIGS. 3 and 5. It will be further noted that the heel platform 18 and the ball platform 20 are substantially flat or planar. In the present embodiment the exercise shoe 10B is a unitary structure with its above-described structural elements being formed integrally such as by suitable injection molding.

Particularly, and as is shown most clearly in FIG. 5, it will be understood that the opposed rearward end portions 53 and 54 of the side frame members or rails 32 and 34 are provided with a plurality of opposed pairs of holes or openings 61-62, 63-64 and 65-66. A cylindrical rearward range of rocking motion limiting member 68 is included in the frame 30, note particularly FIG. 5, and the member 68 is provided with a threaded bore 69 extending therethrough for receiving opposed pair of threaded bolts 71-72. The rearward range of rocking motion limiting member 68 is for being mounted in any one of three different positions in the opposed rearward end portions 63 and 64 of the rails 32 and 34 by being placed opposite either the pair of opposed holes or openings 61-62, or 63-64, or 65-66 and the threaded bolts 71-72 inserted through the opposed pair of openings with which the member 68 is aligned and the threaded bolts 71-72 threaded inwardly into the threaded bore 69 of the member 68. It will be generally understood that the rearward range of rocking motion limiting member 68 is for providing the exercise shoe 10 with a plurality of different rearward ranges of rocking motion depending upon whether the member 68 is mounted opposite opposed pair of holes 61-62, 63-64, or 65-66. It will be further generally understood that the position in which the member 68 is mounted in the opposed rearward portions 53 and 54 of the rails 32 and 34 in combination with the opposed forward end portions 51 and 52 and opposed rearward end portions 53 and 54 will provide the exercise shoe 10B with a plurality of different ranges of rocking motion and more particularly with a plurality of different rearward ranges of rocking motion. It will be further understood that providing the exercise shoe 10B with a plurality of variable more limited ranges of rearward rocking motion, the limiting member 68 provides the exercise shoe 10B with a plurality of overall (combined forward range of rocking motion and rearward range of rocking motion) more limited ranges of rocking motion.

Figure 6:
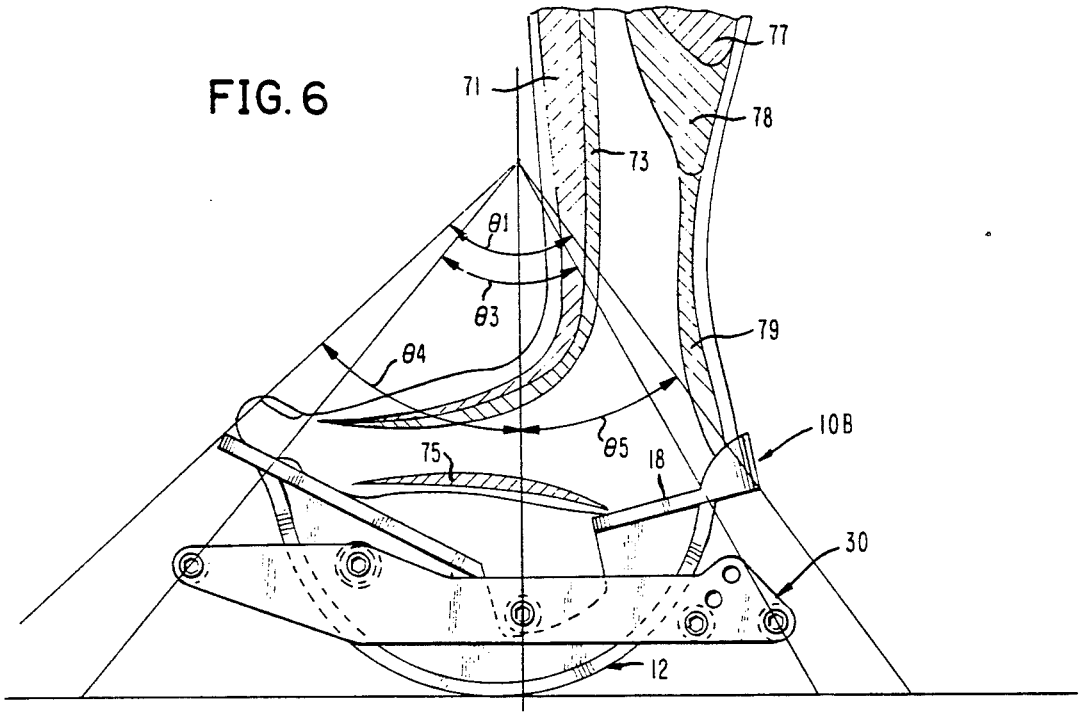
FIG. 6 is a side view of the exercise shoe of FIG. 3 in the neutral position and illustrating the range of rocking motion of the exercise shoe.
Figure 7:
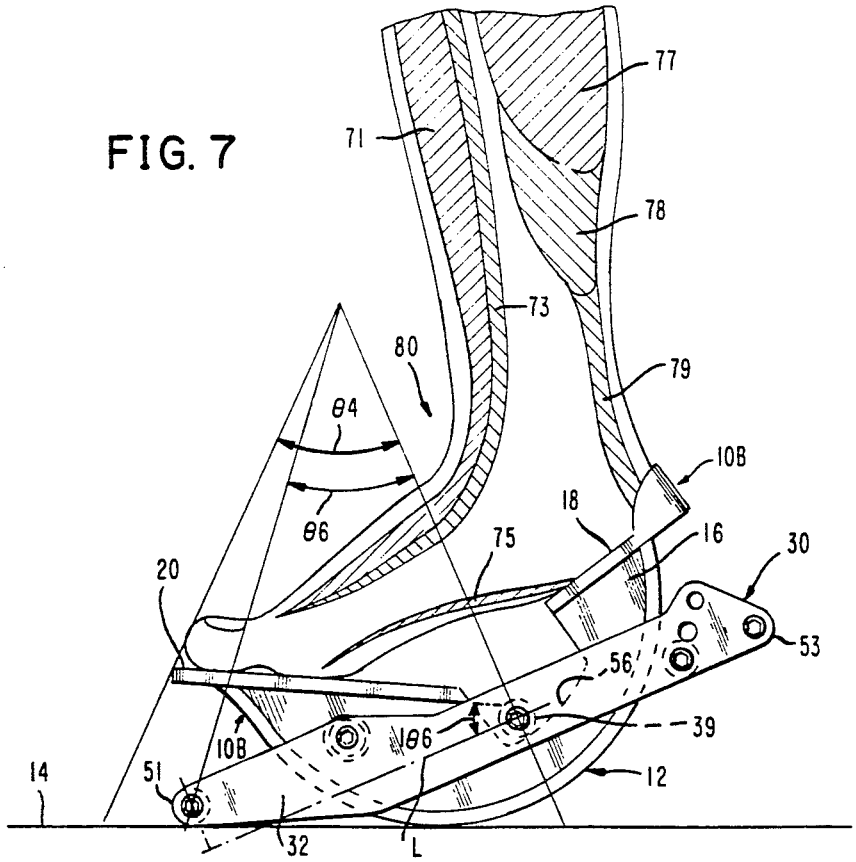
FIG. 7 is a side view similar to FIG. 6 but showing the exercise shoe rocked in the forward direction in a more limited range of rocking motion.

Referring now particularly to FIG. 7, it will be understood that FIG. 7 illustrates the improved exercise shoe 10B being rocked in the forward direction to produce plantar flexion which, as noted above, stretches and strengthens the anterior flexors, i.e. anterior tibialis 71 and the exterior digitorum longus 73 and to some extent the plantar fascia 75. It will be noted from FIG., 7 that upon the exercise shoe 10B being rocked in the forward motion to produce dorsiflexion, the opposed forward end portions 51 and 52 engage the support surface 14 to provide the exercise shoe 10B with a more limited forward range of rocking motion Θ6 which range Θ6 is more limited than the forward range of rocking motion Θ4 (FIG. 6) of the prior art exercise shoe 10. It will be further noted that upon the opposed forward end portions 51 and 52 engaging the support surface 14, the ball platform 20 (sometimes referred to as a toe platform) is positioned or oriented parallel, or at least substantially parallel, with respect to the support surface 14 which orientation prevents the person's foot, indicated by general numerical designation 80, from sliding forwardly off of the exercise shoe 10B. This parallel, or at least substantially parallel orientation of the ball platform 20 is produced by the combination of the length L of the forward portion of the side frame members 32 and 34 and by the fact that the central connecting bar 39 is in engagement with the inwardly extending central portion 55 of the upwardly extending support member 16 which engagement orients the forward portion of the rails or side members 32 and 34 at an angle Θ6 with respect to the ball platform 20.

Figure 8:
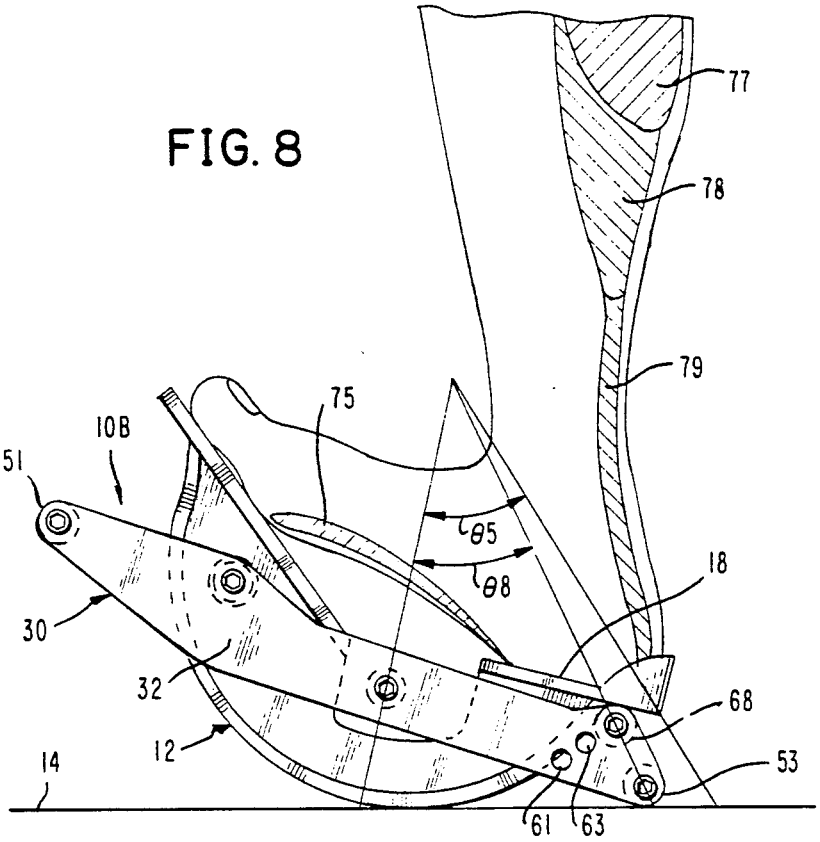
FIGS. 8 and 9 are views similar to FIG. 7 but showing the exercise shoe of FIG. 3 being rocked in the rearward direction in different ranges of more limited rearward rocking motion.

Referring now to FIG. 8, the exercise shoe 10B is shown rocked in the rearward direction with the opposed pairs of end portions 53 and 54 (FIGS. 4 and 5) shown in engagement with the support surface 14. In FIG. 8, the cylindrical rearward range of rocking motion limiting member 68 is shown positioned between the opposed pair of holes 65 and 66 (FIG. 5) with the member 68 engaging the generally semi-circular base 12 of the exercise shoe 10B. In this position of the member 68, the exercise shoe 10B is provided with a more limited range of rearward rocking motion Θ8 which, as will be understood from FIGS. 6 and 8, is more limited than the rearward range of rocking motion Θ5 of the prior art exercise shoe 10. In the position shown in FIG. 8, maximum dorsiflexion occurs providing stretching and strengthening of the plantar flexors, i.e. the gastrocnemius and soleus calf muscles, achilles tendon and plantar fascia.

Figure 9:
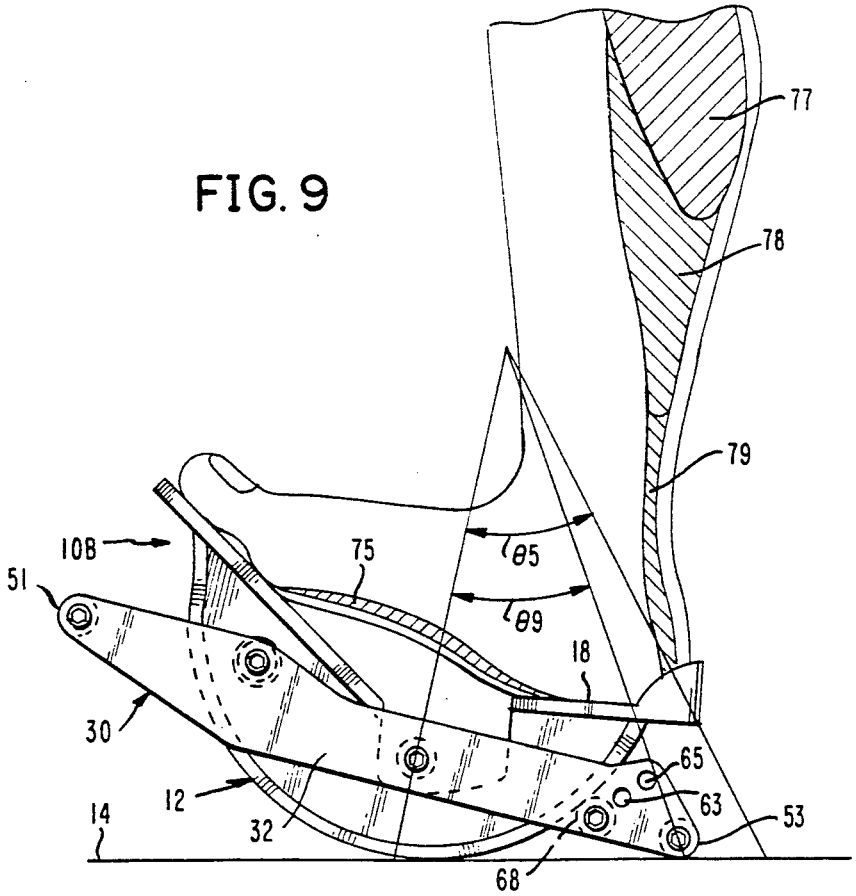

In FIG. 9, minimum dorsiflexion is illustrated, and the cylindrical rearward range of rocking motion limiting member 68 is shown mounted between the opposed holes 61 and 62 (FIG. 5) and in engagement with the base 12 of the exercise shoe 10B. In this position of the member 68, the opposed end portions 53 and 54 (FIGS. 4 and 5) engage the support surface 14 and the exercise shoe 10B is provided with the more limited rearward range of rocking motion Θ9 which is more limited than the rearward range of rocking motion Θ5 of the prior art exercise shoe 10 (FIGS. 6 and 8).

It will be further understood that there is an intermediate range of rearward rocking motion provided by positioning the cylindrical rearward range of rocking motion limiting member 68 in the middle or intermediate opposed pair of holes 63 and 64 (FIG. 5) at which position the member 68 will engage the semi-circular base 12 of the shoe 10B at an intermediate position and provide the exercise shoe 10B with an intermediate more limited rearward range of rocking motion intermediate Θ8 of FIG. 8 and Θ9 of FIG. 9. Thus it will be understood that by positioning the cylindrical rearward range of rocking motion limiting member 68 in different positions between the opposed pairs of holes 61–62, 63–64, or 65–66, the opposed pair of rearward end portions 53 and 54 of the rails or side frame members 32 and 34 will engage the support surface earlier or later in the rearward range of rocking motion thereby providing the exercise shoe 10B with a plurality, or variable, more limited rearward ranges of rocking motion. It will be still further understood that by providing the exercise shoe 10B with a plurality of variable or different more limited rearward ranges of rocking motion, the more limited rearward ranges of rocking motion in combination with the more limited forward range of rocking motion provide the exercise shoe 10B with a plurality, or variable, more limited ranges of rocking motion, i.e. overall more limited ranges of rocking motion.

It will be understood by those skilled in the art that many modifications and variations may be made in the present invention without departing from the spirit and the scope thereof.

What is claimed is:

1. In an exercise shoe including a generally semi-circular base for engaging a support surface on which said exercise shoe rocks, said exercise shoe having a range of rocking motion, WHEREIN THE IMPROVEMENT COMPRISES:

said shoe provided with variable means for providing said exercise shoe with a plurality of more limited ranges of rocking motion.

2. The exercise shoe according to claim 1 wherein said range of rocking motion is a rearward range of rocking motion and wherein said variable means are means for providing said exercise shoe with a plurality of more limited rearward ranges of rocking motion.

3. The exercise shoe according to claim 1 wherein said range of rocking motion includes a forward range of rocking motion and a rearward range of rocking motion and wherein said variable means are means for limiting both said forward range of rocking motion and said rearward range of rocking motion and are also means for providing said exercise shoe with a plurality of more limited rearward ranges of rocking motion.

4. In an exercise shoe including a generally semi-circular base for engaging a support surface on which said exercise shoe rocks with a range of rocking motion, and said shoe further including heel and ball receiving surfaces for respectively receiving the heel and ball of the foot of a person, WHEREIN THE IMPROVEMENT COMPRISES:

variable rocking motion limiting means for being secured to said exercise shoe and for providing said exercise shoe with a plurality of more limited ranges of rocking motion.

5. The exercise shoe according to claim 4 wherein said range of rocking motion is a rearward range of rocking motion and wherein said variable rocking motion limiting means are for limiting said rearward range of rocking motion of said exercise shoe to a plurality of more limited rearward ranges of rocking motion.

6. The exercise shoe according to claim 4 wherein said range of rocking motion includes a forward range of rocking motion and a rearward range of rocking motion and wherein said variable rocking motion limiting means are for limiting both said forward range of rocking motion and said rearward range of rocking motion and are for providing said exercise shoe with a plurality of more limited rearward ranges of rocking motion.

7. The exercise shoe according to claim 1 wherein said variable rocking motion limiting means include outwardly extending first and second rocking motion limiting means, wherein at least one of said first and second rocking motion limiting means are variable and wherein upon variation of said one rocking motion limiting means said first and second rocking motion limiting means are for alternately engaging said support surface and providing said exercise shoe with said plurality of more limited ranges of rocking motion.

8. The exercise shoe according to claim 7 wherein said generally semi-circular base includes a pair of opposed side portions and wherein said variable rocking motion limiting means further includes a pair of side frame members mounted generally along said opposed side portions of said base, said side frame members including pairs of outwardly extending opposed end portions comprising said first and second rocking motion limiting means.

9. The exercise shoe according to claim 4 wherein said range of rocking motion includes a forward range of rocking motion and a rearward range of rocking motion, wherein said generally semi-circular base includes a pair of opposed side portions, wherein said variable rocking motion limiting means further includes a pair of side frame members mounted generally along said opposed side portions of said base, said side frame members including a pair of opposed forward end portions and a pair of opposed rearward end portions and wherein said exercise shoe further includes a variable position rocking motion limiting member for being mounted in different positions in said pair of opposed rearward end portions of said side frame members and upon said variable position rocking motion limiting member being mounted in said different positions said pair of opposed rearward end portions of said side frame members engaging said support surface earlier or later in said range of rearward rocking motion thereby providing said exercise shoe with different ranges of rearward rocking motion.

10. In an exercise shoe including a generally semi-circular base for engaging a support surface on which said exercise shoe rocks with a range of rocking motion, said base including opposed side portions, said exercise shoe further including a support member extending generally upwardly from said base and heel and ball support platforms for respectively receiving the heel and ball of the foot of a person, said heel and ball support platforms mounted on said support member and disposed at an acute included angle with respect to each other,

WHEREIN THE IMPROVEMENT COMPRISES:

a frame for being secured to said exercise shoe, said frame including a plurality of connecting bars and a pair of rails, said connecting bars for mounting said rails opposed to each other and to said opposed side portions of said base, and said rails having outwardly extending opposed forward and rearward end portions and upon said exercise shoe rocking on said support surface, said opposed forward and rearward end portions of said rails alternately engaging said support surface to limit said range of rocking motion of said exercise shoe to a more limited range of rocking motion.

11. The exercise shoe according to claim 10 wherein said range of rocking motion includes a forward range of rocking motion and a rearward range of rocking motion, wherein said exercise shoe includes a rearward range of rocking motion limiting member for being mounted between said opposed rearward end portions of said rails at different positions and upon said rearward range of rocking motion limiting member being mounted in said different positions said opposed rearward end portions of said rails engaging said support surface earlier or later in said rearward rocking motion of said exercise shoe to provide said exercise shoe with a variable range of rearward rocking motion.

12. The exercise shoe according to claim 10 wherein said more limited range of rocking motion includes a more limited rearward range of rocking motion, wherein said support member extending upwardly from said base includes a middle portion extending inwardly thereof to form a cavity substantially centrally thereof, wherein one of said connecting bars is a central connecting bar residing generally in said cavity and extending transverse to and mounted to said rails generally centrally thereof, wherein said rails have a forward length measured forwardly from said central connecting bar, and wherein upon said exercise shoe being rocked forwardly said opposed forward end portions of said rails engage said support surface to limit said forward range of rocking motion to a more limited range of forward rocking motion and said central connecting bar engages said middle portion of said support member and said engagement of said central bar with said middle portion of said support member and said forward length of said rails combine to position said ball platform substantially parallel, to said support surface thereby preventing the foot of said person from sliding forwardly off of said exercise shoe.

* * * * *